United States Patent [19]

Uchida

[11] Patent Number: 4,503,629

[45] Date of Patent: Mar. 12, 1985

[54] SYSTEM FOR COLLECTING AND CONVEYING UNDERSEA MINERAL RESOURCES

[76] Inventor: Masaaki Uchida, 4-13-12 Morishita, Koto-ku, Tokyo, Japan

[21] Appl. No.: 572,915

[22] Filed: Jan. 23, 1984

[51] Int. Cl.[3] ..... E02F 7/00; E02F 3/88

[52] U.S. Cl. ..... 37/57; 37/62; 37/69; 37/DIG. 8; 198/812

[58] Field of Search ..... 198/812; 37/DIG. 8, 37/69, 60, 63, 58, 54, 195, 57; 299/8, 9

[56] References Cited

U.S. PATENT DOCUMENTS

| | | | |
|---|---|---|---|
| 3,621,983 | 11/1971 | Arentzen et al. | 198/812 X |
| 3,766,671 | 10/1973 | Guntert | 37/69 |
| 3,943,644 | 3/1976 | Walz | 37/DIG. 8 |
| 3,968,579 | 7/1976 | Rossfelder | 37/69 |
| 3,971,593 | 7/1976 | Porte et al. | 37/DIG. 8 |
| 3,999,313 | 12/1976 | Andrews | 37/DIG. 8 |
| 4,055,006 | 10/1977 | Shibata | 37/DIG. 8 |
| 4,070,061 | 1/1978 | Obolensky | 37/DIG. 8 |
| 4,120,535 | 10/1978 | Delli-Gatti, Jr. | 198/812 X |
| 4,155,491 | 5/1979 | Istoshin et al. | 37/DIG. 8 |
| 4,232,903 | 11/1980 | Welling et al. | 37/DIG. 8 |

FOREIGN PATENT DOCUMENTS

| | | | |
|---|---|---|---|
| 1468199 | 3/1977 | United Kingdom | 37/DIG. 8 |

*Primary Examiner*—Clifford D. Crowder

*Attorney, Agent, or Firm*—Fleit, Jacobson, Cohn & Price

[57] ABSTRACT

A system for collecting mineral resources on the ocean floor, having an automotive collector for collecting mineral resources, a collection vessel which is connected to the automotive collector so that the collected mineral resources are fed to the collection vessel, and an endless bucket lift device having a number of buckets. The endless bucket lift is lowered from a ship and circulates between the ship and the collection vessel. The circulation of the buckets carries the mineral deposits, collected at the collection vessel, to the ship. The ship has an expansion apparatus having at least a pair of end-rollers on which an endless belt carrying a number of buckets are wound. The distance between the end rollers is adjustable so that the lowering distance of the collection vessel and the automotive collector can be adjusted according to the depth of the seabed.

3 Claims, 14 Drawing Figures

1
3
A
D
D
D
a
b
c
d
e
f
g
96
51
50
2
4b
6b
p
j
i
4a
5b
k
5a
6a
m
o
n
h
q
r
s 1
96
51
50
2
A

SYSTEM FOR COLLECTING AND CONVEYING UNDERSEA MINERAL RESOURCES

BACKGROUND OF THE INVENTION

The present invention relates in general to an undersea mining system for effectively collecting undersea deposits such as mineral resources on the ocean floor.

It is known that there are a great amount of mineral resources on the ocean floor having a depth of about 4,000–6,000 m. These mineral resources include various kinds of minerals such as gold, chromium, nickel, manganese, rutile, diamond, etc., most of which are piled on the surface layer of the ocean floor. For example, there are a great amount of fist-sized manganese, which are called "manganese nodule", on the ocean floor. However, it is difficult to effectively collect such abundant mineral resources, which will be better in quality as one goes deeper in the sea, because they lie on the seabed of about several thousand meters depth.

SUMMARY OF THE INVENTION

A principal object of the present invention is to provide an improved system for collecting mineral resources, which can be operated readily regardless of the depths of the seabed.

Another object of the present invention is to provide a new apparatus for effectively and rapidly lowering and/or raising a device for collecting mineral resources and transporting then to a ship.

According to the present invention, there is provided a system for collecting mineral resources on the ocean floor, having an automotive collector for collecting mineral resources, a collection vessel connected to the automotive collector so that the collected mineral resources are fed to the collection vessel, and an endless bucket lift device having a number of buckets. The endless bucket lift is lowered from a ship and circulates between the ship and the collection vessel. The circulation of the buckets carries the mineral deposits, collected at the collection vessel, to the ship. In the present invention, the ship has a pair of end-rollers on which an endless belt carrying a number of buckets are wound. The distance between the end rollers is adjustable so that the lowering distance of the collection vessel and the automotive collector can be adjusted according to the depth of the seabed.

DETAILED DESCRIPTION OF THE INVENTION

Figure 1:
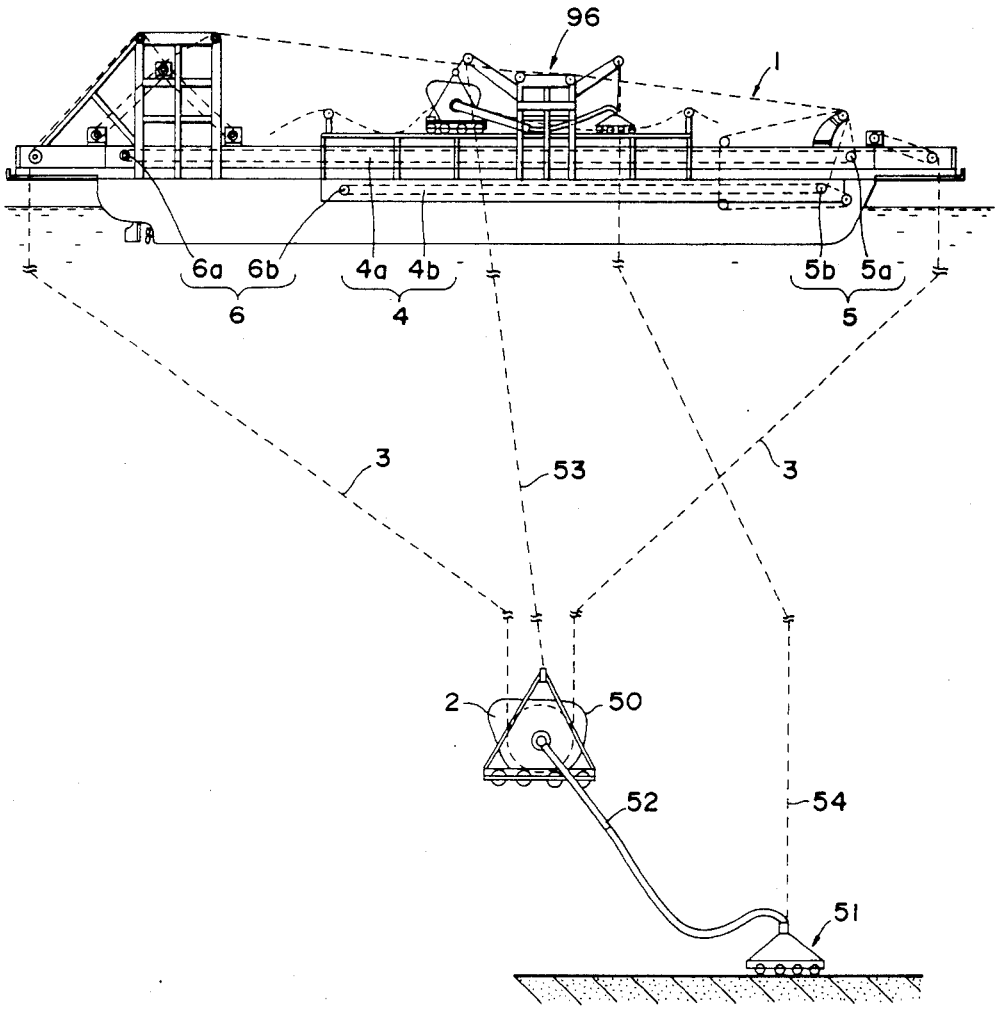
FIG. 1 is an explanatory view which shows a general structure of the invention.

Referring first to FIG. 1, the system of the present invention is loaded on a ship 1. The system has an automotive apparatus 51 for gathering mineral resources piled on the seabed or ocean floor, a collection vessel 50 connected to the automotive gathering apparatus 51 so that the gathered mineral resources are fed to the collection vessel, and an endless bucket lift 3 which is driven to circulate between the ship and the collection vessel 50 for feeding the mineral resources collected at the collection vessel 50 to the ship by a number of buckets which will be described presently.

Figure 2:
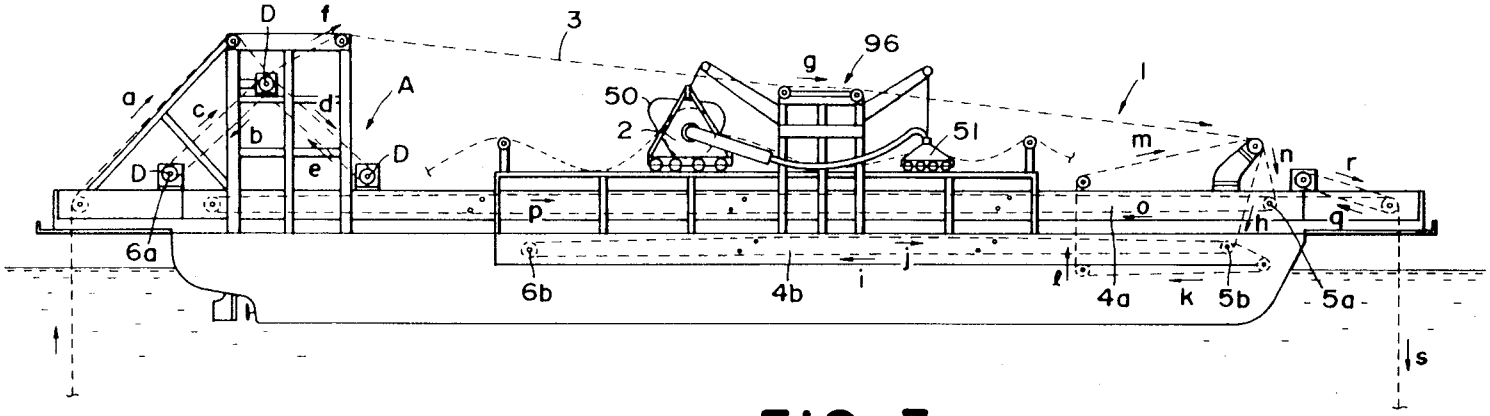
FIGS. 2 and 3 are side view and a plan view, respectively, of a ship which includes an expansion apparatus for adjusting a distance between the ship and a collection vessel for collecting mineral resources.
Figure 3:
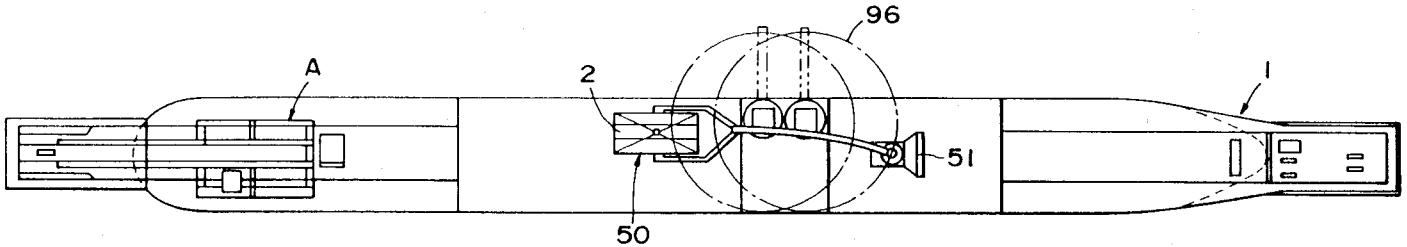

The buckets are continuously circulated between the ship and the collection vessel and, when lifted up to the ship, discharge the undersea deposits or mineral resources onto a place of the ship, which is illustrated by reference numeral A in FIG. 2. A travelling direction of the endless belt is shown by arrows with alphabetical reference characters "a" to "s". Undersea depth varies 4,000 to 6,000 m where undersea deposits are located, and an endless belt of the bucket lift 3 is required to have a length about 10,000 m to 15,000 m. The distance of the collection vessel 50 from the ship and the length of the bucket lift portion within the sea is required to be varied in accordance with the depth of the ocean floor, and the remaining bucket lift portion other than the portion in the sea must be regularly contained in the ship for the purpose of another operation at deeper seabed. Further, the bucket lift is required to be circulated between the ship and the collection vessel 50. The present invention meets the requirements described above.

In the present invention, an expansion apparatus 4*a*, 4*b* is provided on the ship 1 for selectively varying the length of the bucket lift while the bucket lift is circulated. The expansion apparatus has end rollers 5*a*, 6*a*, 5*b*, 6*b*, the relative distance of which can be selectively changed. Endless belts with a number of buckets attached thereto are mounted around the end rollers. By changing the distance between the end rollers 5*a*, and 6*a*, or the end rollers 5*b*, and 6*b*, the depth or location of the collection vessel 50 in the sea can be adjusted. In the illustrated embodiment of the invention, two pairs of expansion apparatus are shown, but only a single pair of device can be provided or alternatively additional expansion apparatus may be provided. It will be understood, however, that multi-layered expansion apparatus can contain longer bucket lift. The expansion apparatus 4*a* can be similar to the other apparatus 5*a*, and for simplification only, the expansion apparatus will be hereinafter be referred to as reference numeral 4, and end rollers as reference numerals 5 and 6 without alphabetical suffix.

The ship 1 is provided with a number of guide rollers for guiding the endless belt of the bucket lift, some of which are operatively connected to a shaft of a driving device for circulating the bucket lift in a smooth manner. These guide rollers are illustrated by reference character D in FIG. 2.

The expansion apparatus 4 is shown in FIGS. 4 through 8. The end roller 5 is rotatably connected to a fixed frame 10, and the other end roller 6 is rotatably connected to a movable frame 11 which is movable relative to an outer frame 12. Specifically, wheels 14 of the movable frame 11 travel along rails 13 on the inside of the outer frame 12, and racks 15 provided adjacent for the rails 13 are engaged with pinions of the wheel axis. The pinion 17 is driven by a driving device through a speed reducer 18 to driving the movable frame 11 so that the movable frame is moved relative to the outer frame 12. Alternatively, both of the frames 10 and 11 can be made movable so that the relative distance thereof can be changed.

Between the fixed frame 10 and the movable frame 11 are disposed a plurality of middle frames 20 (three frames in the illustrated embodiment), which are movable on the rails 13 by their wheels 21. Each of the middle frames 20 has a pinion 22 which is engaged with the rack 15, and the pinion 22 is connected to a motor (not shown) through a speed reducer 23. The middle frames 20 travel at a speed in proportion to the distance from the fixed frame 10. Each of the middle frame 20 has an upper roller 26 which is urged upwardly by a hydraulic cylinder 25 and a lower roller 28 urged downwardly by a hydraulic cylinder 27 so as to prevent vibration and sagging of the frame. The end rollers 5 and 6, upper rollers 26 and lower rollers 28 are each constructed with a plurality of narrow rollers which are freely and independently rotatable, and thus an apparent expansion of the bucket lift 3 can be achieved in a smooth manner.

Figure 4A:
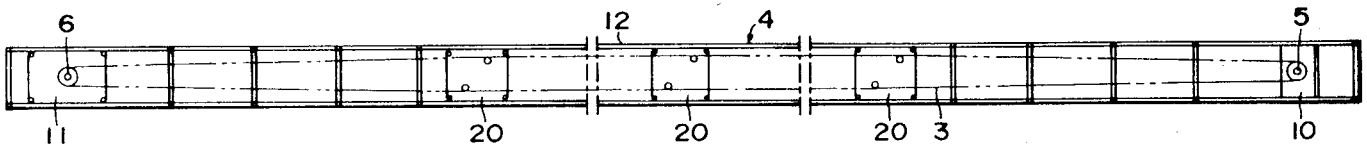
FIGS. 4A and 4B are side views of the expansion apparatus for adjusting a distance between the ship and the collection vessel.
Figure 4B:
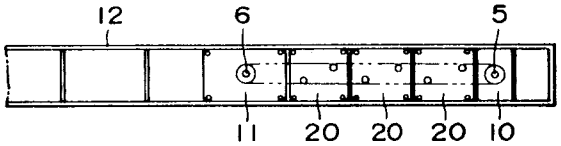
Figure 5A:
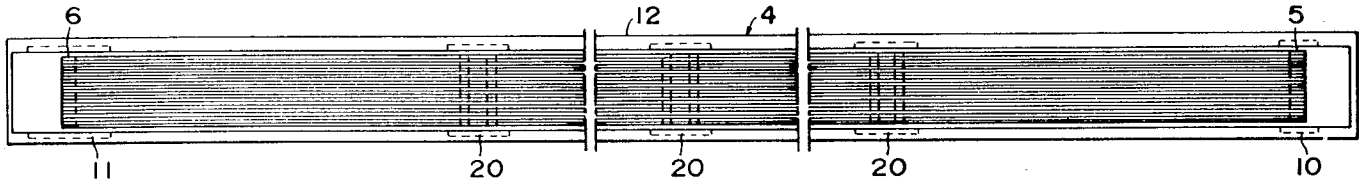
FIGS. 5A and 5B are plan views of the expansion apparatus shown in FIGS. 4A and 4B.
Figure 5B:
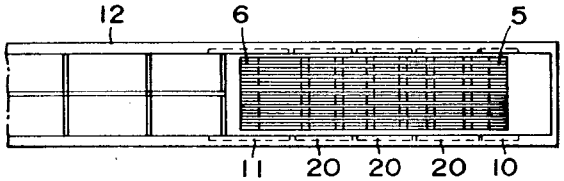
Figure 6:
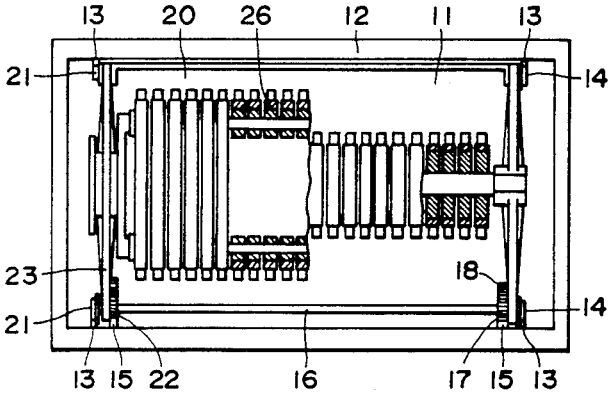
FIG. 6 is a partly sectioned front view of the expansion apparatus, showing end rollers on its right half and a middle frame on its left half.
Figure 7:
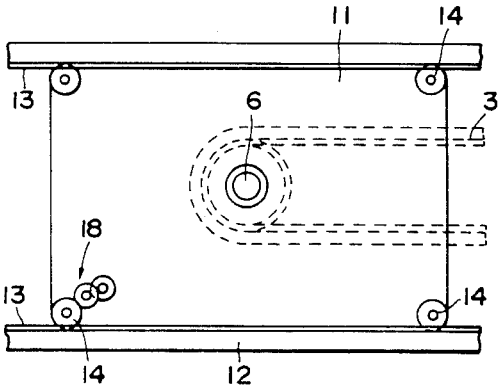
FIG. 7 is an explanatory view of a movable frame of the expansion apparatus.

By the expansion apparatus 4 as described, the length of the endless bucket lift 3 drawn out of the ship can be adjusted and thus the depth of the collection vessel 50 in the sea can be adjusted in accordance with the depth of the seabed where gathering operation of mineral resources are carried out. In case that the seabed is shallow (for example, several ten meters deep), the movable frame 11 is moved in the direction distal to the fixed frame 10 so that distance between them becomes larger, FIGS. 4A and 5A. At this time, the endless belt of the bucket lift 3 is wound by several turns between the end rollers 5, 6. As the movable frame 11 moves, the middle frames 20 are moved. When the end rollers 5, 6 are spaced further from each other as shown in FIGS. 4A and 5A, the cylinders 25, 27 of the middle frame 20 are driven to extend outwardly the upper and lower rollers 26, 28. On the other hand, when the seabed is rather deep, the movable frame 11 is driven to travel towards the fixed frame 10 so that the distance therebetween becomes smaller. At this time, the middle frames 20 also travel along the rails 13, but their upper and lower rollers are not required to be extended outwardly. By the movement of the movable frame 11, the bucket lift 3 which has a length of about 10,000–15,000 m in total can be adjusted in accordance with the depth of the seabed. FIG. 6 shows the end rollers on its right half and middle frame on its left half, for the purpose of simplification only.

Figure 9:
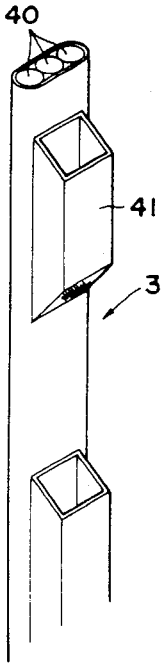
FIG. 9 is a perspective view of an endless bucket lift, showing the structure of the endless belt.
Figure 8:
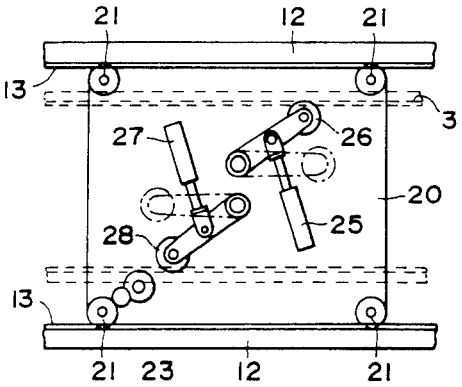
FIG. 8 is an explanatory view of a middle frame of the expansion apparatus.

In the present invention, an endless belt of the bucket lift 3 which is circulated between the ship and the collection vessel 50 is formed of a plurality of synthetic fiber ropes bundled in the form of a planar belt, as shown in FIG. 9. When the system of the present invention is used for collecting manganese nodule, it is preferred that the buckets have a net-like bottom so as to decrease a water resistance when the buckets are lowered into the seawater.

Figure 10:
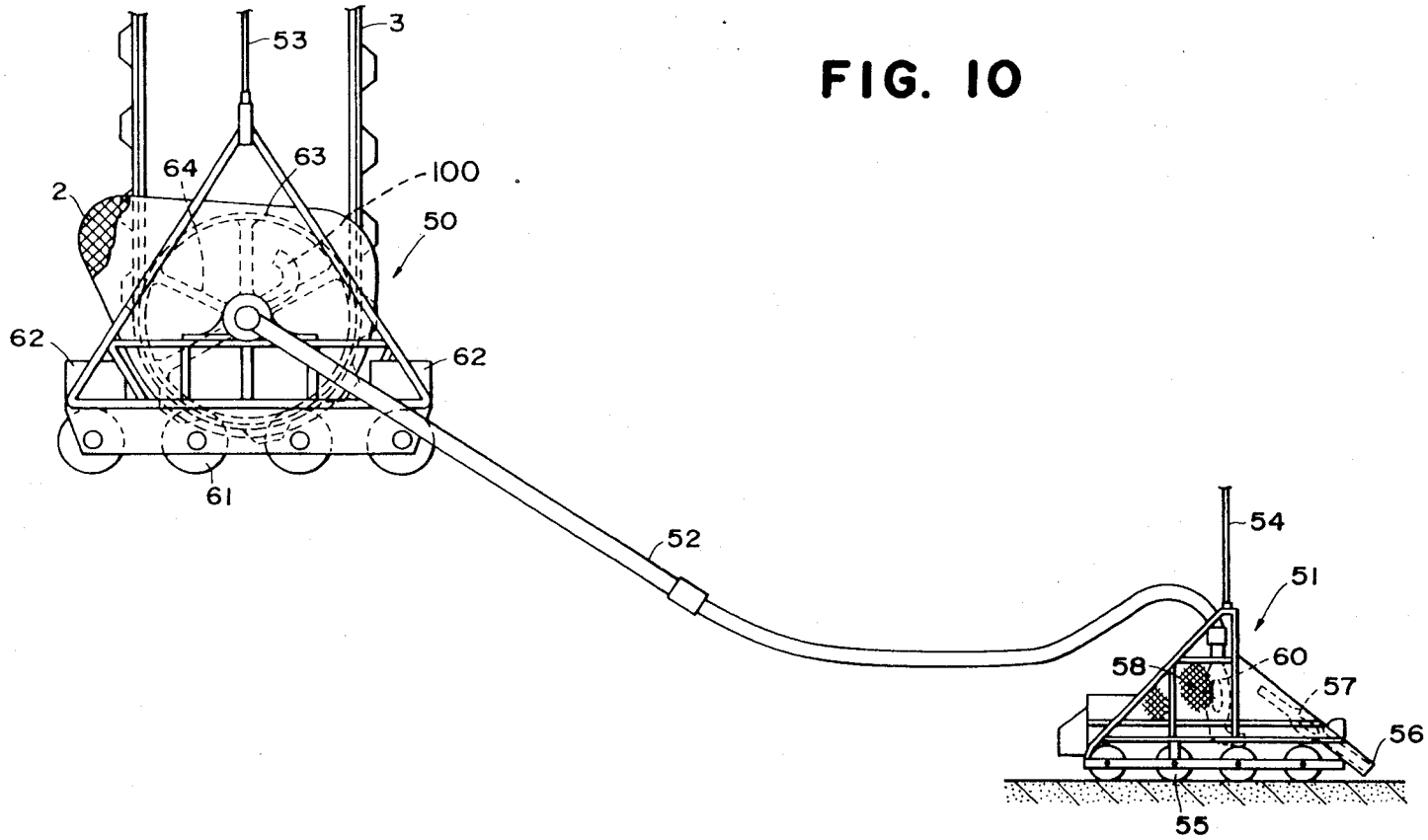
FIG. 10 is a diagrammatic view of a collection vessel and an automotive collector.

The collection vessel 50 is shown in FIG. 10, in which the vessel 50 has a flexible tube 52 extended to connect with an automotive collector, which is shown at 51. If desired, a plurality of automotive collectors may be connected to the collection vessel 50. The collection vessel 50 is principally supported by the bucket lift 3, and additionally connected to the ship 1 by means of a wire 53. Similarly, the automotive collector 51 is connected to the ship by means of a wire 54. These wires 53, 54 may have an electric cable therein, and alternatively, an electric cable may be provided separately. The wires 53, 54 are used for lifting up and down the collection vessel 50 and the automotive collector 51.

The automotive collector 51, which gathers undersea mineral deposits and feeds them to the collection vessel 50 has wheels and necessary equipment for remotely controlling the operation of the automotive collector 51 such as, for example, a TV camera, headlights, and a screw or any other propelling device for movement on the seabed. The automotive collector 51 has at its front lower portion a plurality of inlets, through which manganese nodules are sucked by a pump 57. Preferably, jet nozzles are provided adjacent to the inlets 56 so as to splash unnecessary soil matters and effectively collect necessary mineral resources. The mineral resources sucked by the automotive collector 51 are gathered at first within a net-like container portion 58 of the collector 51 and sifted or screened to remove unnecessary materials such as muds and sands. By this step of operation, a soil matter containing rate of the gathered mineral resources is decreased from about 30% to the rate of about 15%.

The mineral resources thus obtained are fed through the flexible tube 52 to the collection vessel 50 by means of another pump 60 in the automotive collector 51. The collection vessel 50 has wheels 61 and a driving device such as a screw or water jet system 62. The mineral resources transported through the flexible tube 52 are discharged into the collection vessel 50. At the turning point of the circulating bucket lift 3, there is provided a wheel 63 which has an agitator 100 at its spoke portion so that the mineral resources in the collection vessel 50 is agitated when the wheel 63 is rotated along with the travel of the bucket lift 3 to decrease the soil matter containing ratio upto about 5%. In order to prevent foreign matters such as soils from entering the space between the endless belt of the bucket lift 3 and the wheel 63, a brush or a cover may be provided at the position where the belt will be in contact with the wheel 63. The collection vessel 50 can be positioned on or above the seabed.

Figure 11:
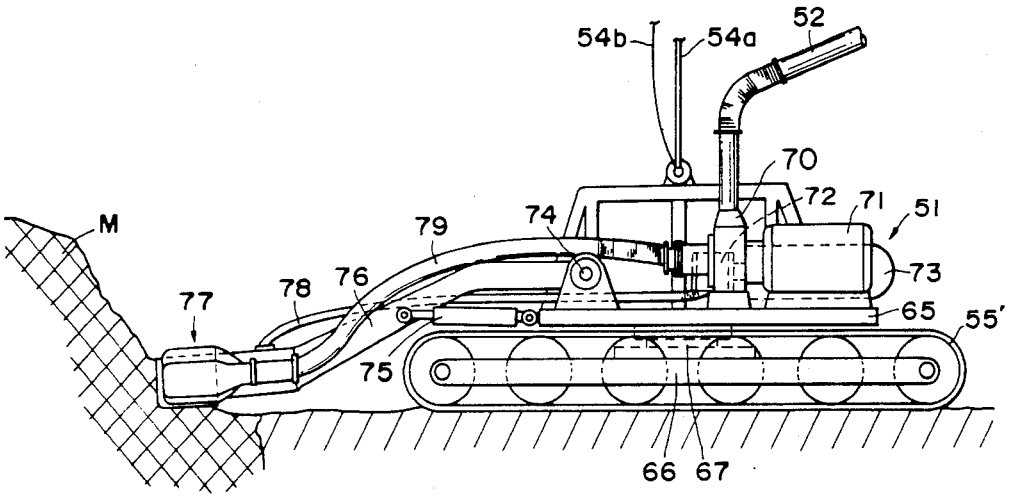
FIG. 11 is a diagrammatic view of an automotive collector according to another embodiment of the invention.
Figure 12:
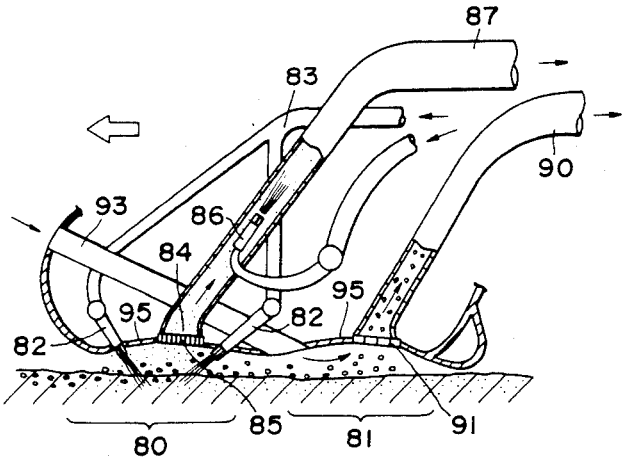
FIG. 12 is a partly sectioned diagrammatic view of a portion of an automotive collector according to another embodiment of the invention.

Modifications of the automotive collector are shown in FIGS. 11 and 12. The modified automotive collector 51 shown in FIG. 11 is desirable for collecting metallic sulfide of hydrothermal deposit.

In FIG. 11, the automotive collector 51 is lowered from the ship by a wire **54*a* and placed on the seabed. Reference numeral 54*b* is an electric cable for driving the collector 51 by caterpillars 55'. The collector 51 has a base 65 which is pivotable on a trunk 66 about a rotary shaft 67. On the base 65, there are provided a suction pump 70, a motor 71 for driving the suction pump, a high pressure discharging pump 72 with its driving motor 73, and an arm 76 which extends forward and is pivotable about a supporting point 74. The arm 76 has at its extended end a mining port 77** for gathering metallic sulfide of hydrothermal deposit M.

In the automotive collector shown in FIG. 11, the high pressure discharging pump 72 is driven to feed high pressurized water into the mining port 77 to drive a hydromotor (not shown) having a rotary rock-cracker. At the same time, the suction pump 70 is driven to produce a negative pressure to forcibly introduce the cracked rocks into a suction tube 79 and to the aforementioned collection vessel 50 shown in FIG. 10 through the flexible tube 52.

FIG. 12 shows a further modification of an automotive collector shown in FIG. 11. The collector in this embodiment is effective for collecting manganese nodules, and has an excavation-selection portion 80 and a collection portion 81 located at the rear of the excavation-selection portion 80. The portion 80 has nozzles 82 for injecting high pressure water against the seabed and a discharge pipe 87 having an opening 84 adjacent to the injection nozzles 82, the other end of the the discharge pipe 87 is opened to form an outlet (not shown) at the rear end of the automotive collector so that soil matters other than the mineral resources are discharged out of the outlet. The nozzles are connected to a pump (not shown) through a pipe 83. A number of discharge pipes 87 are connected together and opened at its outlet. Reference numeral 86 is a jet nozzle for producing a suction force at the opening 84 of the discharge pipe 87 and reference numeral 85 is a filter.

The collection portion 81 which is provided at the rear of the excavation-selection portion 80 has a collection tube 90 having an opening with a lattice 91. The other end of the collection pipe 90 is connected through a suction pump, such as pump 70 in FIG. 11, to the tube 52 (FIG. 11). In FIG. 12, reference numeral 93 represents a pipe for discharging seawater, by means of a suitable discharge means (not shown), as illustrated by an arrow so that the discharged seawater is introduced into the collection tube 90 along with mineral resources, and that soil matters at the position of the excavation-selection portion 80 are not introduced into the collection tube 90. In the drawing, reference numeral 95 represents a bottom wall of the apparatus.

Referring back to FIG. 1, when the ship arrives at the predetermined position, a crane 96 is operated to lower the collection vessel 50 and the automotive collector 51. At this time, the bucket lift 3 is also lowered into the sea together with the collection port 2 having the collection vessel 50. A length of the bucket lift 3 is adjusted by the expansion apparatus 4 in accordance with the depth of the seabed to be mined. This is accomplished, as described above, by the movement of the movable frame 11 towards the fixed frame 10. When the collection vessel 50 and the automotive collector 51 are lowered to the predetermined portion, a mining operation starts. Mineral deposits are collected by the automotive collector 51 and then transported through the flexible tube 52 to the collection vessel 50. Thereafter the mineral deposits collected in the collection vessel 50 are transported to the ship by the circulating bucket lift 3.

According to the present invention, a length of the bucket lift 3 can be adjusted immediately in accordance with the depth of the seabed, by controlling the expansion apparatus disposed in the ship. Further, circulation of the bucket lift between the ship and the collection vessel can feed collected mineral resources to the ship effectively.

Although the present invention has been described with reference to the preferred embodiments thereof, many modifications and alterations can be made within the spirit of the invention.

What is claimed is:

1. A system for collecting mineral resources on the seabed of an ocean floor, comprising:

an automotive collector for gathering mineral resources on the seabed, said automotive collector being movable on the seabed by a remote control from a ship, said automotive collector having first pump means for sucking mineral deposits on the seabed, and second pump means for transporting the sucked mineral deposits, a collection vessel means, connected to said automotive collector through a tube, for collecting mineral resources gathered by said automotive collector, said collection vessel means having a vessel for temporarily storing the gathered mineral resources, and a wheel within said vessel, said wheel having an agitator for agitating the mineral deposits fed from said automotive collector, said second pump means of the automotive collector feeding the sucked mineral deposits to said collection vessel means, an endless bucket lift having an endless belt with a number of buckets attached thereto, said endless bucket lift being continuously movable between said collection vessel means and the ship so that mineral resources collected into said collection vessel are continuously fed to the ship by said endless bucket lift, said wheel of the collection vessel means being rotatable along with a movement of said endless bucket lift, and an expansion apparatus, provided on the ship, having at least a pair of end rollers, at least one of said end rollers being movable toward and away from the other end roller of said end rollers, said endless bucket lift being wound on said end rollers so that said endless bucket lift can travel through said end rollers to and from said collection vessel, wherein an effective length of said bucket lift lowered from the ship into the seawater is adjusted in accordance with a depth of the seabed by changing the distance between said end rollers.

2. The system according to claim 1, wherein said automotive collector has wheels for movement on the seabed.

3. The system according to claim 1, wherein each of said end rollers are movable in opposite direction with each other.

* * * * *